US011408682B2

(12) United States Patent
Krolla

(10) Patent No.: US 11,408,682 B2
(45) Date of Patent: Aug. 9, 2022

(54) SHELL AND TUBE HEAT EXCHANGER

(71) Applicant: Kelvion Machine Cooling Systems GmbH, Monzingen (DE)

(72) Inventor: Stefan Krolla, Braunweiler (DE)

(73) Assignee: Kelvion Machine Cooling Systems GmbH, Herne (DE)

( * ) Notice: Subject to any disclaimer, the term of this patent is extended or adjusted under 35 U.S.C. 154(b) by 0 days.

(21) Appl. No.: 17/622,636

(22) PCT Filed: Jul. 24, 2020

(86) PCT No.: PCT/DE2020/100663
§ 371 (c)(1),
(2) Date: Dec. 23, 2021

(87) PCT Pub. No.: WO2021/013312
PCT Pub. Date: Jan. 28, 2021

(65) Prior Publication Data

US 2022/0163265 A1 May 26, 2022

(30) Foreign Application Priority Data

Jul. 25, 2019 (DE) ..... 10 2019 120 096.2

(51) Int. Cl.
*F28D 7/00* (2006.01)
*F28F 9/22* (2006.01)
*F28D 7/10* (2006.01)

(52) U.S. Cl.
CPC ..... *F28D 7/10* (2013.01)

(58) Field of Classification Search
CPC . F28D 7/10; F28D 7/06; F28D 7/1607; F28D 7/0075; F28F 9/22; F28F 2009/226
(Continued)

(56) References Cited

U.S. PATENT DOCUMENTS 2,986,454 A 5/1961 Jewett
3,374,832 A 3/1968 Tucker
(Continued)

FOREIGN PATENT DOCUMENTS

DE 2 257 427 5/1973
DE 24 54 757 5/1976
(Continued)

OTHER PUBLICATIONS

International Search Report dated Nov. 4, 2020 by the European Patent Office in International Application PCT/DE2020/100663.

*Primary Examiner* — Davis D Hwu
(74) *Attorney, Agent, or Firm* — Henry M. Feiereisen LLC

(57) ABSTRACT

A shell and tube heat exchanger includes a tube bundle for passage of a first medium from a first inlet to a first outlet. A second medium flows through a flow space which surrounds the tube bundle. The tube bundle includes first tubes communicating with the first inlet, and second tubes communicating with the first outlet and fluidly connected to the first tubes. The first tubes define an outer enveloping surface which is predominantly adjacent to an enveloping surface of the second tubes. A separating body between the first inlet and a tubesheet which separates the flow space from the first medium prevents the first medium from flowing against the tubesheet and includes inlet tubes which bridge a compensation space between the separating body and the tubesheet and which protrude into the first tubes to direct the first medium into the first tubes while bypassing the tubesheet.

9 Claims, 7 Drawing Sheets

(58) Field of Classification Search
USPC ..... 165/160
See application file for complete search history.

(56) References Cited

U.S. PATENT DOCUMENTS

| | | | | |
|---|---|---|---|---|
| 3,451,472 | A | 6/1969 | Keck | |
| 4,585,057 | A | 4/1986 | Marburger | |
| 2011/0186275 | A1* | 8/2011 | Jekerle | F28F 27/02 165/172 |
| 2018/0231280 | A1 | 8/2018 | Moreaux | |
| 2018/0306528 | A1* | 10/2018 | Girardi | F28D 7/06 |

FOREIGN PATENT DOCUMENTS

| | | |
|---|---|---|
| DE | 29 43 649 | 5/1980 |
| DE | 32 15 601 | 10/1983 |
| DE | 92 10 444.4 | 1/1993 |
| GB | 1 212 526 | 11/1970 |
| WO | WO 2013/182426 | 12/2013 |

* cited by examiner

SHELL AND TUBE HEAT EXCHANGER

CROSS-REFERENCES TO RELATED APPLICATIONS

This application is the U.S. National Stage of International Application No. PCT/EP2020/100663, filed Jul. 24, 2020, which designated the United States and has been published as International Publication No. WO 2021/013312 A1 and which claims the priority of German Patent Application, Serial No. 10 2019 120 096.2, filed Jul. 25, 2019, pursuant to 35 U.S.C. 119(a)-(d).

BACKGROUND OF THE INVENTION

The invention relates to a shell and tube heat exchanger.

A shell and tube heat exchanger can, e.g., be configured such that a cryogenic medium flows into a lower cross-sectional half of a cylindrical heat exchanger, flows through the heat exchanger in longitudinal direction, is deflected by 180° at the end of the cylindrical heat exchanger, and flows back to the common tubesheet via a tube bundle in the upper half of the heat exchanger. The semicircular tube fields of the tubesheet have the consequence that the lower half of the tubesheet has a correspondingly low temperature due to the cryogenic medium, while the second semicircular tube field in the tubesheet is significantly warmer. The direct flow of cryogenic media against the tubesheet leads to stress peaks within the tubesheet. This also applies to heat exchangers in which the medium is not deflected, Le, in which the medium flows against the entire tubesheet.

The invention is based on the object to provide a shell and tube heat exchanger in which the thermal stress on the tubesheet, the tube connection to the tube bundle and the tube bundle is reduced.

SUMMARY OF THE INVENTION

This object is achieved in a shell and tube heat exchanger as set forth hereinafter.

The subclaims set forth advantageous refinements of the invention.

The shell and tube heat exchanger according to the invention includes a tube bundle in a shell, with the shell having a first inlet and a first outlet for a first medium for passage through the tube bundle. Furthermore, the shell has a second inlet and a second outlet for a second medium for passage through a flow space within the shell in surrounding relation to the tube bundle. The heat exchanger has tubesheets to hold the tubes and to separate the two media from one another.

A separating body is arranged as a flow distributor between the first inlet and the tubesheet. The function of the separating body is to prevent the first medium from flowing directly against the tubesheet. In order for the first medium to still be able to enter the tube bundle, inlet tubes are arranged on the separating body. The inlet tubes bridge a compensation space between the separating body and the tubesheet and protrude into the individual tubes of the tube bundle. By means of the individual tubes, the first medium is conducted directly into the tubes while bypassing the tubesheet. There is no direct flow against the tubesheet.

The fact that the separating body is directly exposed to the flow and significantly cooled down, in particular when a cryogenic medium flows against it, has in accordance with the invention no influence on the thermal stress in the tubesheet because the tubesheet is decoupled from the separating body. The tubesheet is connected directly to the separating body solely via the shell. The tubesheet, the tube connections and also the tubes are relieved considerably.

The individual inlet tubes in particular are not firmly connected to the tubes of the tube bundle. This compensates for thermal changes in length between the inlet tubes and the tubes of the tube bundle. The separating body is used for thermal decoupling from the tubesheet.

Shell and tube heat exchangers which have inlet and outlet located at one end of the shell, while a deflection chamber is arranged at the other end of the shell, exhibit greater thermally induced stress within the tubesheet due to their design. The temperature gradient in the tubesheet is greater. For example, the temperature of a cryogenic medium could be −160° C. at the first inlet and +50° C. at the first outlet. In this case, the temperature difference within the tubesheet is over 200° C.

It is therefore provided that the tubesheet is not divided into an upper half and a lower half. The first inlet is connected to a first group of tubes of the tube bundle which group is adjacent to a second group of tubes. The first group has an outer enveloping surface which is predominantly, i.e. more than 50%, adjacent to an enveloping surface of the second group. The second group can enclose or surround the first group over more than 180° and in particular completely enclose it. The second group of tubes is then essentially arranged in form of a ring around the first group of tubes. In other words, a core area and an edge area are involved. The areas are not necessarily strictly concentric. A distinction can essentially be made between an inner group and an outer group of tubes, with the second group as outer group having a larger proportion of tubes which are adjacent to the shell than the first, inner group.

The first medium initially flows through the first group via an end-side deflection or also a deflection chamber and after the deflection back again through the second group. Both groups of tubes are also connected to a common tubesheet. However, a more beneficial temperature gradient is realized compared to semicircular tube fields. In the case of a cryogenic medium, the temperatures in the core area are much lower than in the edge area to the transition to the shell. The temperature gradient runs in a star shape between the core area and the outer areas. In combination with the separating body, which serves as a flow distributor and which protects the core area of the tubesheet from directly being flowed at, it is achieved that the tubesheet is significantly shielded with the arrangement of the groups of tubes according to the invention and is therefore exposed to significantly lower thermally induced stress than with an arrangement with semicircular tube patterns. This is of particular advantage when using cryogenic gases or liquid nitrogen, because stress peaks are capped. A radial temperature gradient, instead of a temperature gradient extending from the edge to across the center, also results in a more favorable stress distribution within the tube bundle.

Because there is no need for separating structures within the heat exchanger (inlet) chamber, there is another advantage in that a greater number of tubes by approx. 20% can be installed within the tubesheet or the cylindrical shell while maintaining the same nominal diameter. Smaller nominal diameters considerably reduce the required wall thicknesses for high pressure applications. Likewise, this means a reduction in the outer diameter of the heat exchanger while the number of tubes is the same. As a result, the mass and the manufacturing costs can be reduced.

According to an advantageous refinement of the invention, the inlet tubes extend over at least half a thickness of the tubesheet. The thickness is measured between an upstream side and a downstream side of the tubesheet, in relation to the flow direction of the first medium. The inlet tubes preferably completely traverse the tubesheet, so that the first medium, e.g. a cryogenic medium with a very low temperature, is introduced away from a fastening point of the tubes in the tubesheet. The tubes can be welded to the tubesheet. Due to the better accessibility, the tubes are welded to the tubesheet from the upstream side. As the inlet tubes bridge these upstream connection points of the tubes and conduct the especially cryogenic medium deeply into the tubes of the tubesheet, the connection points between the tubes and the tubesheet are additionally relieved.

According to a further preferred configuration of the invention, the shell and tube heat exchanger is designed as a double-tube safety heat exchanger. In a double-tube safety heat exchanger, the tubes which carry the first medium are respectively arranged in an outer tube. The second medium only comes into contact with the outer tube. The first medium only comes into contact with the inner tube. A leakage space which can be monitored is located between the inner tube and the outer tube. The outer tubes are fastened in a tubesheet for the outer tubes. The leakage space is located on the downstream side of the tubesheet for the inner tubes. The tubesheets are arranged at a distance from one another so as to establish a common leakage space that can be monitored and is connected to ail the intermediate spaces between the inner and outer tubes. This leakage space can also be used as a test space to monitor the pressure of a test medium in the leakage space.

According to an advantageous configuration of the invention, provision is made for a further separating body which serves as a flow collector and which, viewed in the flow direction of the first medium, is arranged behind an outlet-side tubesheet and anteriorly of the first outlet. This design relates to a shell and tube heat exchanger in which the first inlet is located at one end of an especially cylindrical shell and the first outlet is located at the opposite end of the cylindrical shell. In such a design, the first medium is therefore not deflected into an end-side collecting chamber. The provision of a separating body may also be useful during discharge from such a shell and tube heat exchanger in order to reduce stress peaks at the tubesheet. The separating body has discharge tubes which are fluidly connected to the tubes that carry the first medium in order to guide the first medium through the outlet-side tubesheet and the separating body to the first outlet, There is a compensation space between the separating body and the tubesheet in order to compensate for diverging thermal changes in length of the discharge tubes with respect to the tube bundle and the tubesheet Advantageously, a mirror-image arrangement is involved for the configuration on the inlet side of the shell and tube heat exchanger. Both ends of the shell and tube heat exchanger can consequently be configured identically.

According to a refinement of the invention, a collecting chamber is arranged anteriorly of the inlet-side tubesheet. The second group of tubes feeds into this collecting chamber. The first outlet is connected to the collecting chamber. The collecting chamber has an essentially ring-shaped configuration. It can be delimited from the compensation space in a fluid-tight manner. The collecting chamber is preferably connected to the compensation space in a fluid-conducting manner. The compensation space is preferably used not only to compensate for thermal changes in length between the separating body and the tubesheet, but also to accommodate leakages caused by having the inlet tubes preferably longitudinally displaceable in the tubes of the tube bundle. Preferably, the inlet tubes are only inserted with play into the tubes that carry the first medium, wherein a narrow annular gap remains which is sufficient to compensate for thermally induced changes in length. However, there is a limited leakage flow to the compensation space, especially with gaseous media. The compensation space is accordingly filled with the leakage flow of the first medium.

In a particularly advantageous manner, the compensation space is at the same time a component of the collecting chamber for the medium flowing back. The leakage flows are normally so small that they can be neglected. Sealants can be arranged between the inlet tubes and the tubes of the tube bundle.

It is regarded as particularly favorable, when the inlet tubes completely traverse the separating body and are connected to the separating body on the inlet side. The separating body is a separate component which is preferably welded into the shell. The inlet tubes are in turn connected to the separating body, preferably on the inflow side, i.e. on their side facing the first inlet. They are, for example, materially connected to the separating body. The production is comparable to the production of a tube bundle that is connected to a tubesheet. Accordingly, the separating body can be designed like a tubesheet as a disk-shaped body which has a plurality of openings into which the inlet tubes are inserted. The same applies to the structure of a separating body used as a flow collector and mounted on the outlet side of a tube bundle through which there is a unidirectional flow in the longitudinal direction.

The invention makes it possible for the first inlet to be directly opposite the separating body if necessary. The direct flow against the separating body is harmless to the thermal stress within the shell and tube heat exchanger and in particular within the tube bundle due to the only indirect flow against the tubesheet or tube bundle. Of course, the invention does not exclude an arrangement of the inlet at an angle other than 180° in relation to the separating body, so that the inflowing first medium is deflected.

It is considered advantageous to feed the inlet into an inflow chamber. It may, optionally, be expanded in the shape of a funnel. There is no need for the cross section of the inlet to correspond to the cross section of the tube bundle or the one of the separating body. The inflow chamber serves to disperse the inflowing medium evenly over all openings in the separating body or the individual inlet tubes and thus evenly across the tube bundle.

BRIEF DESCRIPTION OF THE DRAWING

The invention is described in more detail hereinafter with reference to FIGS. 5 to 11. The other FIGS. 1 to 4 described hereinafter are used only to illustrate the claimed invention and do not involve embodiments of the invention. The drawings show schematically illustrated exemplary embodiments. It is shown in:

DETAILED DESCRIPTION OF PREFERRED EMBODIMENTS

Figure 1:
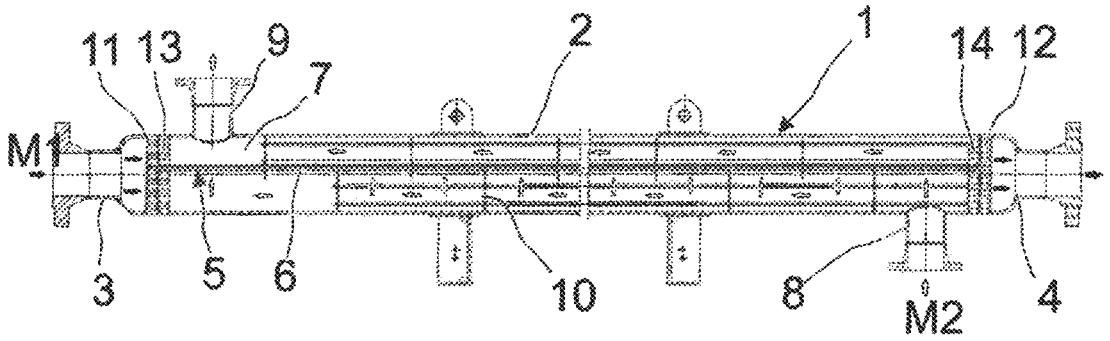
FIG. 1 a longitudinal section of a first design of a shell and tube heat exchanger (prior art)

FIG. 1 shows a shell and tube heat exchanger 1 according to the prior art. On the basis of this shell and tube heat exchanger 1, the essential components are labeled which can also be found in the following designs according to the invention starting from FIG. 5.

The shell and tube heat exchanger 1 includes a shell 2. The shell 2 is cylindrical. The shell 2 has a first inlet 3 in the image plane on the left and a first outlet 4 in the image plane on the right for a first medium M1 which flows into the first inlet 3 and flows out of the first outlet 4. The first medium M1 is conducted through a tube bundle 5. For better illustration, only a single tube 6 of the tube bundle 5 is depicted.

The tube bundle is surrounded by a flow space 7 for a second medium M2. The second medium M2 flows in the image plane on the right via a second inlet 8 through the flow space 7 to the second outlet 9 at the other end of the shell 2. The second medium M2 is hereby deflected several times within the shell 2. For this purpose, baffles 10 are arranged in the shell 2 so that the flow path of the second medium M2 is lengthened. The second medium M2 does not come into contact with the first medium M1. For this purpose, the tubes 6 of the tube bundles 5 are fastened in tubesheets 11 at the first inlet and to a tubesheet 12 at the first outlet 4. In this exemplary embodiment, the shell and tube heat exchanger is designed as a double-tube safety heat exchanger. For this purpose, each tube 6 is surrounded by an outer tube which is connected in a second tubesheet 13 at the first inlet 3 or a second tubesheet 14 at the first outlet 4. The intermediate space between the tubesheets 11, 13 or 12, 14 can be monitored for leak detection. For this purpose, the tubesheets 11, 13 or 12, 14 are located at a small distance from one another.

Figure 2:
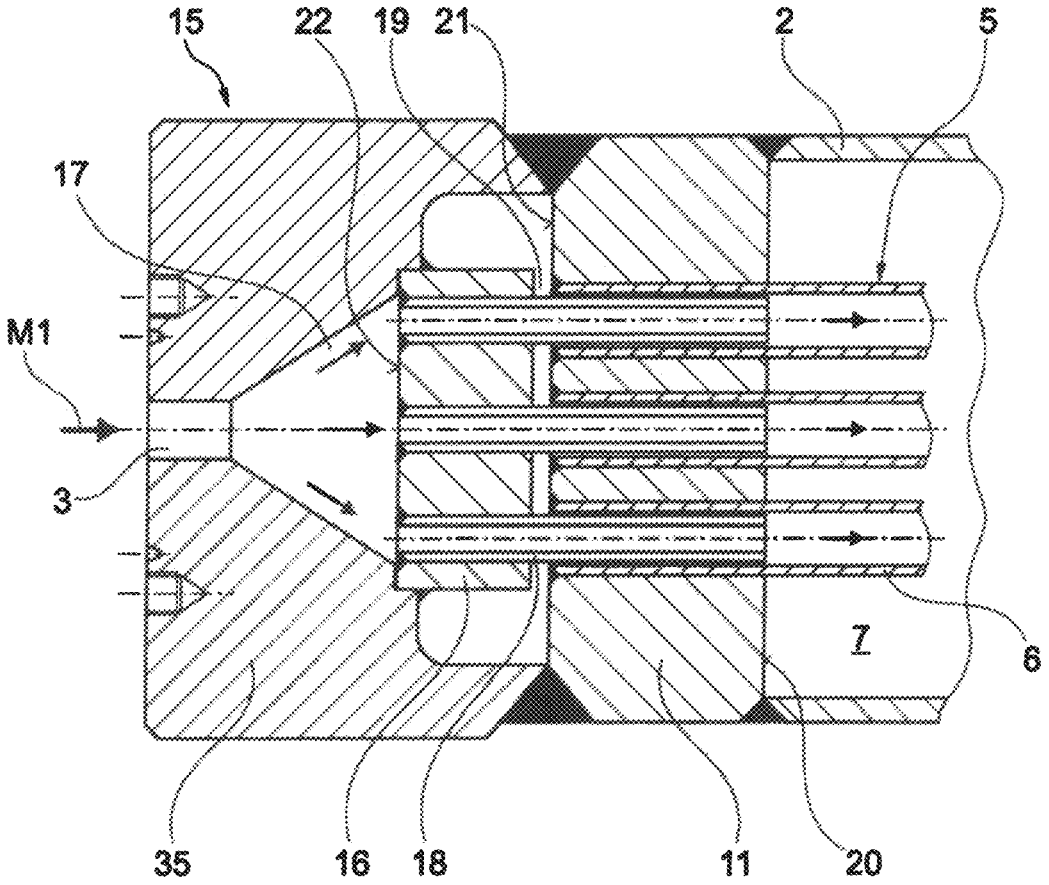
FIG. 2 a longitudinal section of the end region of a shell and tube heat exchanger according to a first design (one-way version)

FIG. 2 shows a shell and tube heat exchanger 15. In this shell and tube heat exchanger 15, the reference numerals mentioned in relation to FIG. 1 continue to be used for components that are essentially structurally identical. The shell and tube heat exchanger 15 includes a cylindrical shell 2 with a first inlet 3 for the first medium M1. Inside the cylindrical shell 2, a tube bundle 5 extends through a flow space 7 for a second medium, not shown in detail, which can flow into and out of the shell 2 via the second inlet 8 or second outlet 9 shown in FIG. 1. The tubes 6 of the tube bundle 5 are secured in a tubesheet 11. In addition, a separating body 16 is located between the tubesheet 11 and the inlet 3. It serves as a flow distributor, as illustrated by the fan-like arrows hi a funnel-shaped widening inflow chamber 17 in a head piece 35 of the shell 2, The head piece 35 is welded to the tubesheet 11 and the tubesheet 11 is in turn welded to the cylindrical part of the shell 2. The entire shell and tube heat exchanger 15 is cylindrical. The tubesheet 11, the separating body 16 and the associated head piece 35 are therefore also cylindrical in this exemplary embodiment. The separating body 16 is configured in a disk shape and has several through openings in which the inlet tubes 18 extend. The inlet tubes 18 are arranged in alignment with the tubes 6, so that an inlet tube 18 is aligned opposite the tube 6 of the tube bundle 5 in the axial direction. The inlet tubes 18 all have the same length. They extend through the separating body 16 and bridge a gap-shaped compensation space 19 anteriorly the tubesheet 11. They extend up to a downstream side 20 of the tubesheet 11 and thus also traverse the entire tubesheet 11.

When the medium M1 flows into the inflow chamber 17 through the one first inlet, the flow is only directly against the separating body 16 or the inlet tubes 18 arranged therein. There is no direct flow against the tubesheet 11, The medium M1 only enters the tube bundle 5 on the downstream side of the tubesheet 11. To compensate for thermal changes in length, the inlet tubes 18 are longitudinally displaceable relative to the tubes 6 of the tube bundle 5. Any leakage flows are caught in the compensation space 19. Here they cannot escape because the compensation space 19 is limited on the one hand by the separating body 16 and circumferentially by the head piece 35. The first medium M1 can only flow into the tubes 6 of the tube bundle 5.

FIG. 2 shows that the tubes 6 of the tube bundle 5 are fixed on an upstream side 21 of the tubesheet 11, in particular by welding. The inlet tubes 18 are also fixed on the inlet side on a front side 22 of the separating body 16 in facing relation to the first medium M1.

Figure 3:
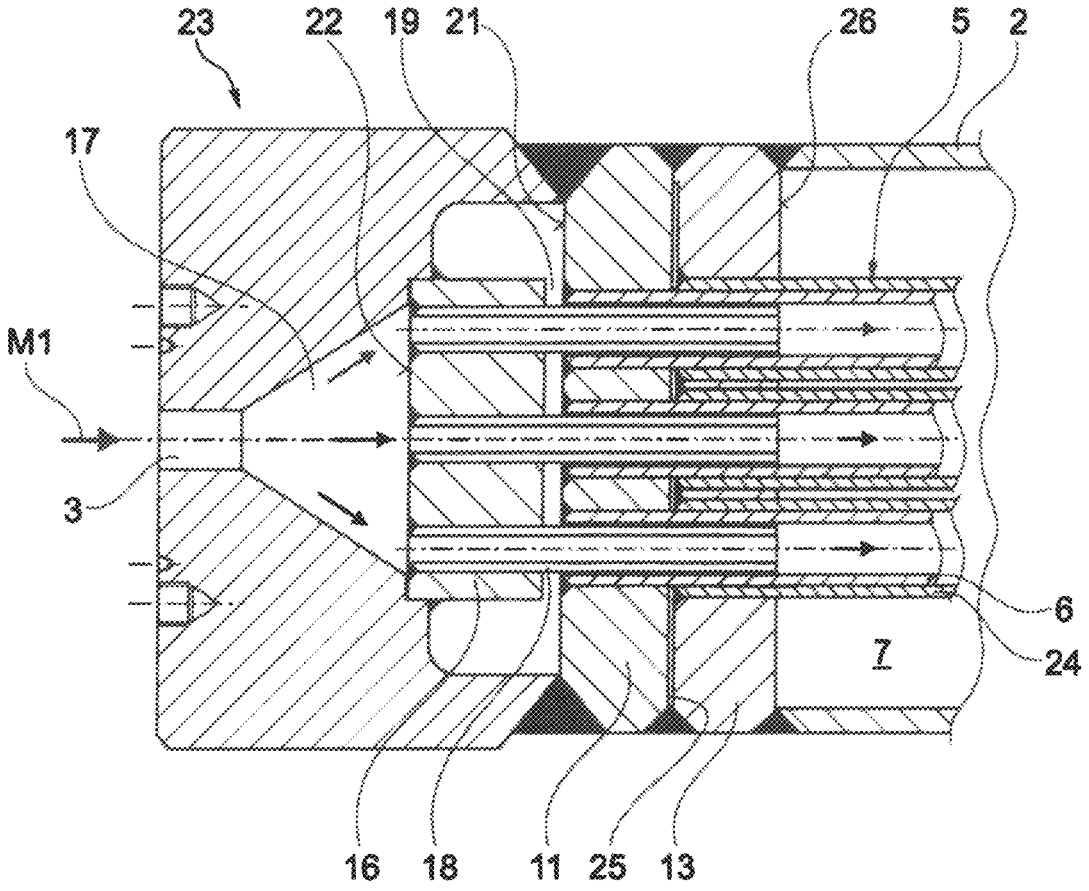
FIG. 3 a longitudinal section into the end region of a shell and tube heat exchanger according to a second design.

The design of FIG. 3 differs from the one of FIG. 2 in that the shell and tube heat exchanger 23 is designed as a double-tube safety heat exchanger, With regard to the basic mode of operation, reference is made to the descriptions relating to FIG. 2. The reference signs introduced there for FIG. 3 are also adopted. In addition, the design of FIG. 3 has an outer tube 24 for each tube 6 carrying the medium M1, which outer tube is secured in the inlet-side tubesheet 13 (see FIG. 1). A leakage space which can be monitored is located between the outer tube 24 and the respective inner tube 6. Since the tubesheet 13 for the outer tubes 24 is arranged at a small distance from the tubesheet 11 for the tubes 6 of the tube bundle 5, a leakage monitoring can be carried out. For this purpose, the intermediate space 25 is connected to the leakage space between the tube 6 for the medium M1 and the outer tube 24. The leakage monitoring is not shown.

In contrast to the design in FIG. 2, the inlet tubes 18 also extend through the second tubesheet 13 for the outer tubes 24. Accordingly, the inlet tubes 18 end on the downstream side 26 of the second tube sheet 13. All other structural features are identical to the exemplary embodiment in FIG. 2.

Figure 4:
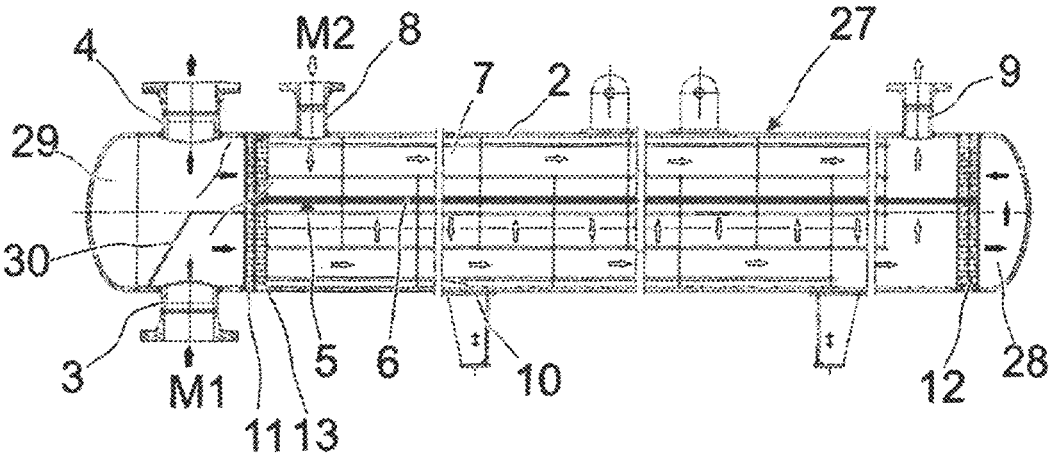
FIG. 4 a longitudinal section of a shell and tube heat exchanger with an end-side deflection chamber (prior art)

FIG. 4 shows a further prior art shell and tube heat exchanger 27. The essential difference compared to the shell and tube heat exchanger of FIG. 1 is that the shell and tube heat exchanger 27 has a deflection chamber 28 in the image plane on the right, with the first inlet 3 and the first outlet 4 for the first medium M1 being arranged in the image plane on the left. The shell 2 is cylindrical. Accordingly, a circular tube pattern results here in tubesheet 11. The shell and tube heat exchanger 27 is again designed as a double-tube safety heat exchanger, so that there is also a second tubesheet 13 for each of the outer tubes, which are not shown in detail. In this exemplary embodiment, the second medium M2 enters via the first inlet 8. Like in the first design, the first outlet 4 is arranged adjacent to the first inlet 8. Only the first inlet 3 is arranged at a distance from the second outlet 9. Located at the inlet-side end in the image plane on the left is a partition plate 30 in a chamber 29 in order to separate the medium M1 inflowing from below from the medium M1 outflowing above.

Figure 5:
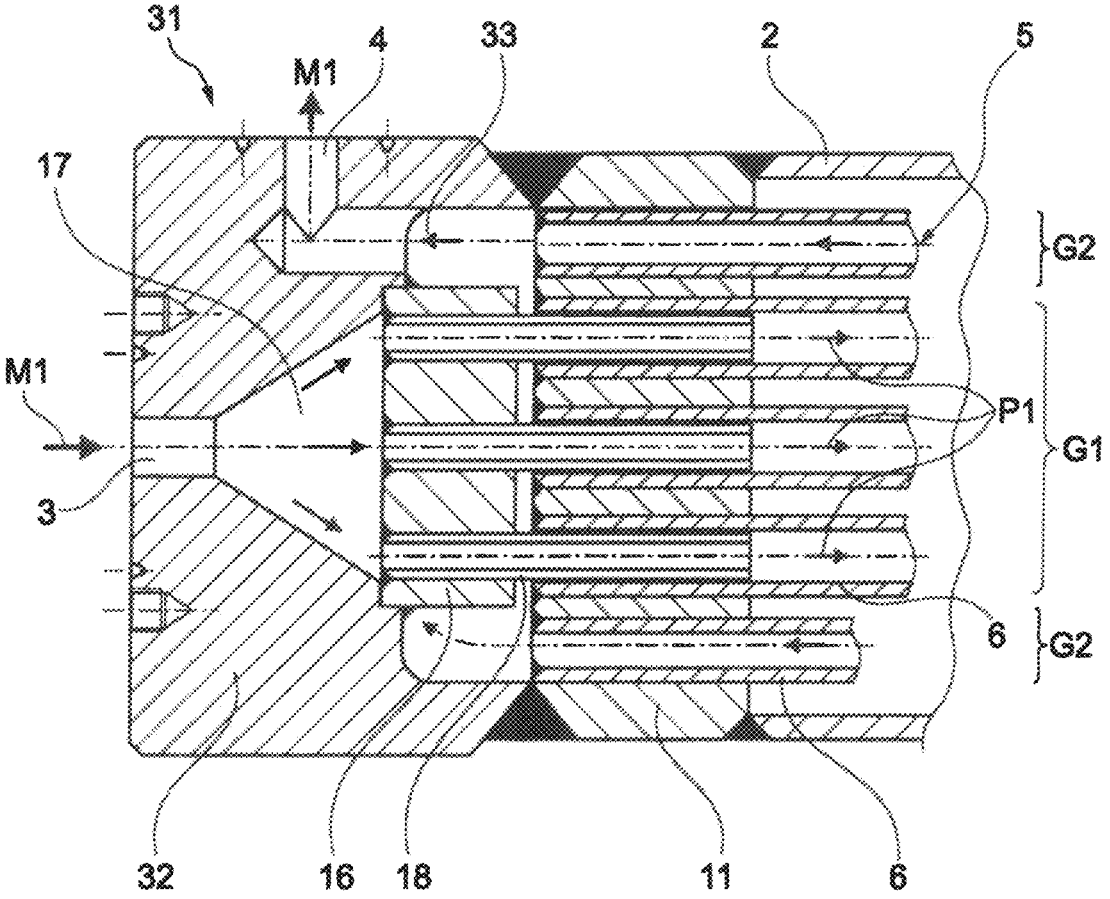
FIG. 5 a longitudinal section through the end region of a heat exchanger in a first embodiment of the invention (multi way version)
Figure 7:
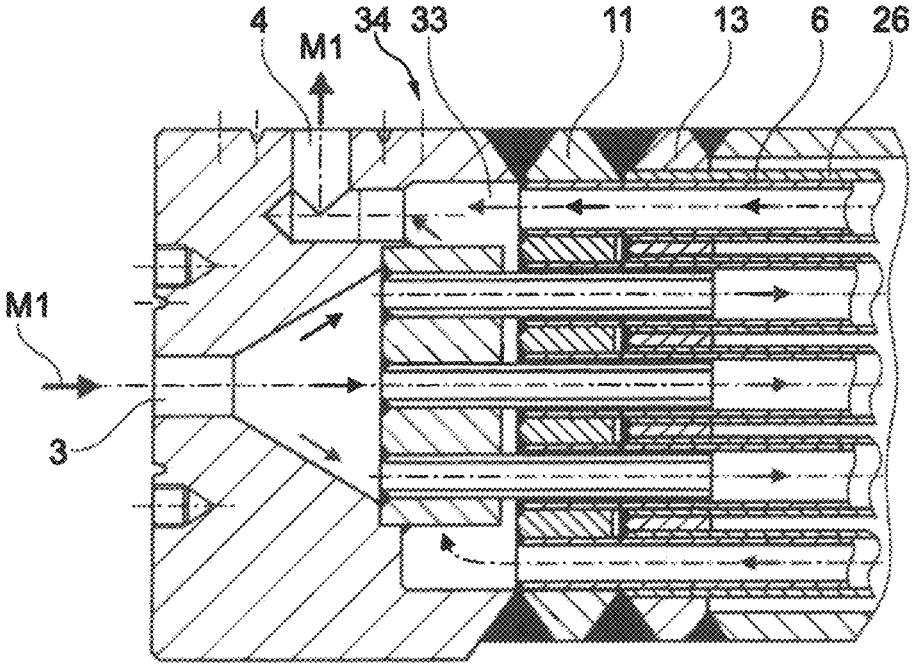
FIG. 7 a longitudinal section through an end region of a heat exchanger in a further embodiment (multi-way version)

In a shell and tube heat exchanger of this type—regardless of whether it is designed as a double-tube safety heat exchanger or as a single-tube heat exchanger—provision may be made for an additional separating body 16, as shown in the exemplary embodiments in FIGS. 5 and 7. The separating body 16 does not differ from the one of the exemplary embodiment in FIGS. 2 and 3. The tubesheet 11 is also configured identically. However, the head piece 32 is configured differently. The medium M1 flows into the head piece 32 via the first inlet 3, then flows through the inflow chamber 17 in order to enter the individual inlet tubes 18 in the separating body 16. The medium M1 now flows into the tubes 6 of the tube bundle 5. However, in contrast to the exemplary embodiment in FIG. 1, the medium M1 only flows into a first group G1 of tubes 6. These are those tubes 6 into which the inlet tubes 18 extend. They form the core of the tube bundle 5, in which all arrows P1 (flow direction of M1) in the image plane run from left to right. The tubes 6 of the first group G1 feed into a deflection chamber as designated by reference numeral 28 in FIG. 4. A tubesheet 12 is also arranged there, so that the first medium M1 flows out of the core area and is directed into those tubes 6 which surround the first group G1 of tubes 6. This is the second group G2 of tubes 6. This second group G2 is located radially outside the first group G1. As far as possible, this second group G2 surrounds the first group G1 virtually about the circumference.

Figure 6:
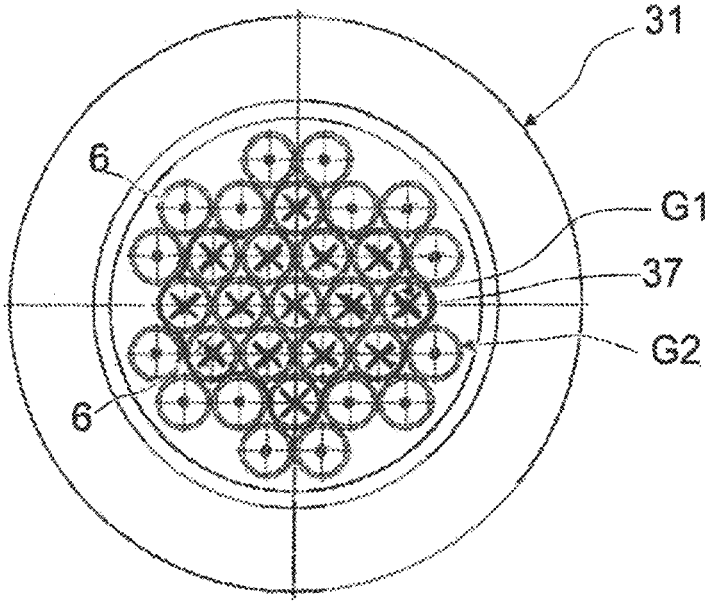
FIG. 6 an end view of a tubesheet of a heat exchanger according to the invention.

FIG. 6 shows an example of a tube field in the direction of view upon the end face of a tubesheet 11. The first group G1 of tubes 6 is marked with an X. The first medium M1 flows into these tubes 6 into the image plane. It is deflected behind the second tubesheet 12 and flows back again via the tubes 6 of the second group G2. These tubes 6 are marked with a point in the center. The point illustrates the opposite flow direction. FIG. 6 also shows an enveloping surface 37 of the first group G1. The enveloping surface 37 surrounds the first group G1 of tubes 6. It is shown with a broken line. It does not physically exist, but merely designates a boundary between the first group G1 and the second group G2. In addition, it is apparent from the enveloping surface 37 that it is adjacent to an enveloping surface of the second group G2 by more than 50%. The inner enveloping surface of the second group G2 corresponds to the outer enveloping surface 37 of the inner group G1. They are congruent above one another. The two enveloping surfaces are therefore not only partly adjacent, but rather the enveloping surface of the second group G2 surrounds the enveloping surface 37 of the first group G1.

The returning medium M2 flows out of the tubes 6 of the second group G2 into a collecting chamber 33. This collection chamber 33 has a ring-shaped configuration. All tubes 6 of the outer or second group G2 feed into the collecting chamber 33. The collecting chamber 33 in the head piece 32 is connected to the first outlet 4 for the medium. In this case, the first outlet is located in the image plane above. There is no need for a partition plate, as in the exemplary embodiment in FIG. 4. The separating body 16 separates the returning medium M1 from the inflowing medium. In addition, the separating body 16 is predominantly situated within the collecting chamber 33 and is swept around by the returning medium M1 in the collecting chamber 33. At the same time, the compensation space 19 is also located within the collecting chamber 33. The compensation space 19 is connected to the collecting chamber 33 in a fluid-conducting manner, so as to enable any leakage flows to transition from the compensation space 19 into the collecting chamber 33 and to also flow off via the first outlet 4 for the first medium M1.

Figure 8:
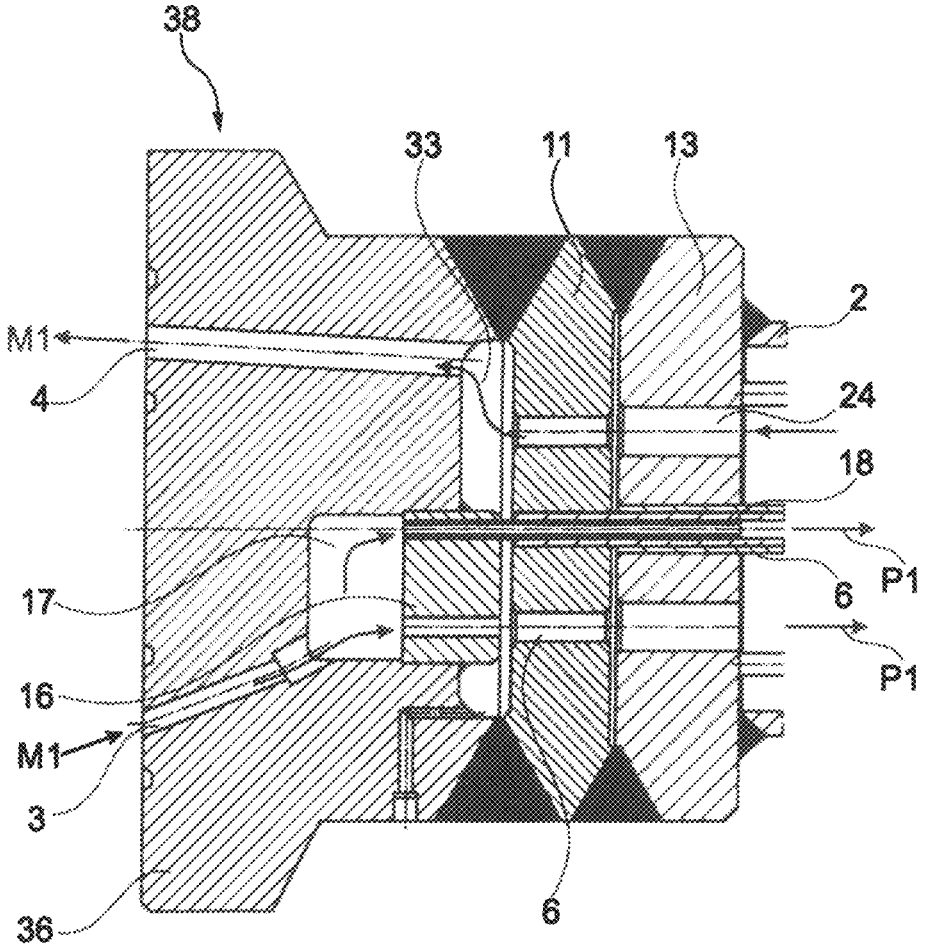
FIG. 8 a longitudinal section of a further exemplary embodiment through the end region of a shell and tube heat exchanger according to a further embodiment (multi-way version)

The exemplary embodiment in FIG. 7 differs from the one in FIG. 5 only in the installation of a second tubesheet 13, which is connected to corresponding outer tubes 24. Otherwise, reference is made to the description of FIG. 5 and the reference numerals introduced there and to the preceding description of FIG. 3, which also shows the design as a double-tube safety heat exchanger. The shell and tube heat exchanger 34 according to FIG. 7 is thus a combination of the design of FIGS. 5 and 3, FIG. 8 shows a further exemplary embodiment with a head piece 36 of different configuration. In this exemplary embodiment, the first inlet 3 is not positioned directly opposite the separating body 16. The first inlet 3 is located at the end face eccentrically and essentially in the lower half of the head piece 36. The first inlet 3 leads into the inflow chamber 17 via a feed line. In this exemplary embodiment, the inflow chamber 17 is not arranged centrally in the head piece 36, but rather arranged eccentrically. It is predominantly located in the lower half of the head piece 36. In contrast to the other exemplary embodiments, it is also not funnel-shaped, but in this sectional view rectangular and essentially matches the tube pattern of the tubesheet in FIG. 9.

Figure 9:
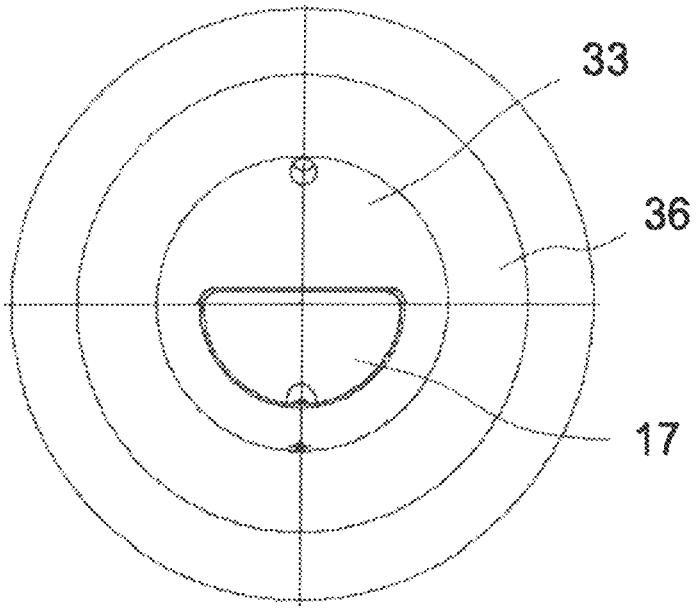
FIG. 9 a view of a head piece of the shell and tube heat exchanger according to FIG. 8 from the direction of view of the tube bundle.

FIG. 9 shows the head piece 36 by way of a view upon the inflow chamber 17 from the direction of view of the tube bundle. The inflow chamber 17 is configured from this viewing direction essentially semicircular or semi-cylindrical with rounded corners. The access to the first inlet 3 is located in the lower area of the inflow chamber 17. The passage to the first outlet 4 (FIG. 8) is connected to the collecting chamber 33 in the upper area. The collecting chamber 33 is essentially circular and surrounds the inflow chamber 17 about the circumference.

Figure 10:
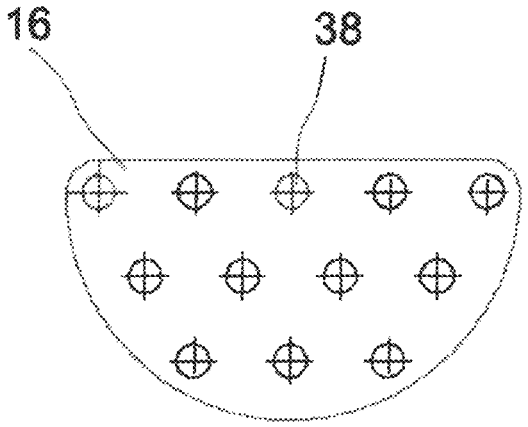
FIG. 10 an end view of a separating body according to the exemplary embodiment of FIG. 8.

FIG. 10 shows a detailed illustration of the separating body 16. It is inserted into the inflow chamber 17 of FIG. 9. The assembly situation is shown in FIG. 8. In the installed position, the separating body 16 is welded to the inflow chamber 17 in a fluid-tight manner about the circumference and closes it off against the collecting space 33. The inlet tubes 18 are inserted into the individual through openings 38 in the separating body 16, as can be seen in FIG. 8.

Figure 11:
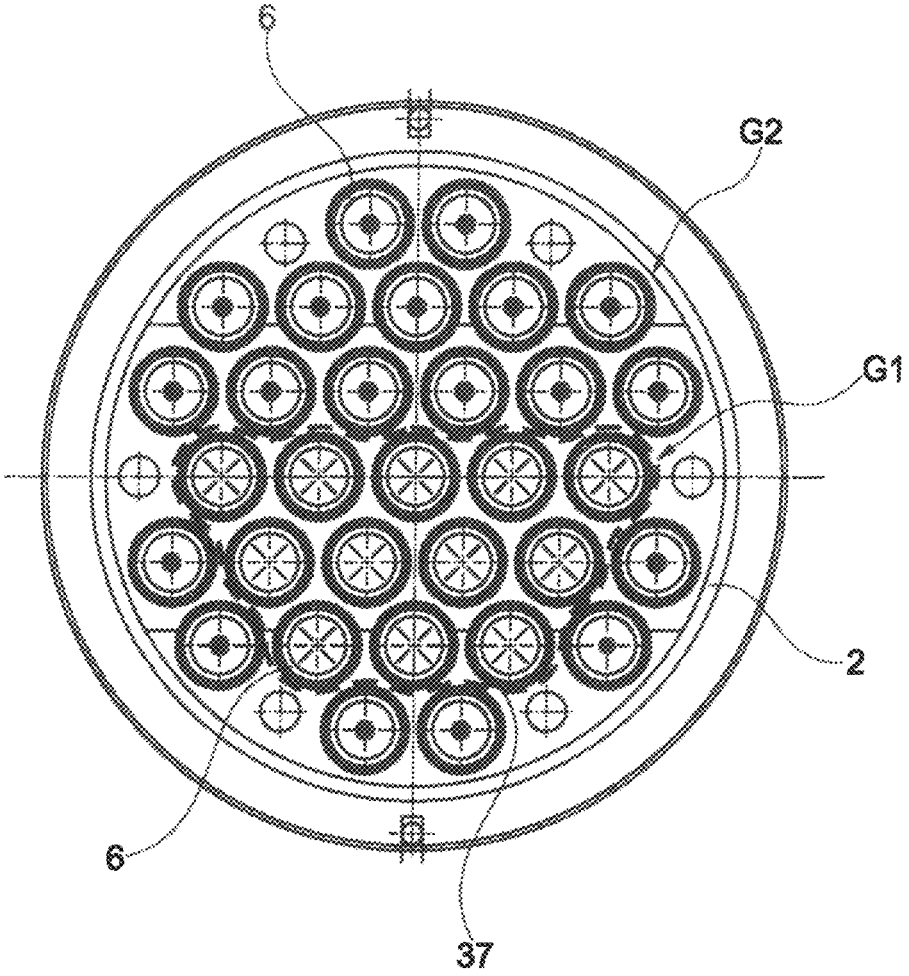
FIG. 11 an end view of a tubesheet of a shell and tube heat exchanger according to the design of FIG. 8.

The drilling pattern of the through openings 38 in the separating body 16 corresponds to the hole pattern in the tubesheet 11 according to FIG. 11. Like in the exemplary embodiment in FIG. 6, the tubes 6 marked with X designate the tubes of the first group G1. FIG. 11 shows an enveloping surface 37 as boundary between the first group G1 and the second group G2. The inner enveloping surface of the second group G2 is identical to the outer enveloping surface 37 of the first group G1. The difference to the exemplary embodiment in FIG. 6 resides in the offset arrangement to the underside of the image plane of the first group G1 in relation to the second group G2. When using cryogenic media, this arrangement of the tubes 6 or the placement of the groups G1, G2 can be of advantage.

The first group G1 of tubes 6 is predominantly located in the lower half of the tubesheet 11. This exemplary embodiment makes it clear that the two groups G1, 52 of tubes 6 do not have to be arranged concentrically, but that tubes 6 of the second group G2 are arranged at least about the major circumferential area of the first group G1. In the event, space constraints render it impossible to arrange lateral tubes 6 of the second group G2 next to the tubes 6 of the first group G1, as is the case, for example, in the horizontal plane, then these positions in the tubesheet 11 remain free. In this case, the distance of the tubes 6 of the first group G1 from the edge of the tubesheet 11 or the distance from the inside of the enclosing shell 2 is greater than the distance of the outer tubes 6 of the second group G2 to the shell 2.

In an embodiment not shown in greater detail, it would even be possible to assign the two lowermost tubes to group 51 in the tube pattern in FIG. 11, i.e. to use them as inflow tubes. Also in this case, three sides and thus the predominant part of the tubes 6 of the first group G1 would be surrounded on the outside by the second group G2 in relation to their common enveloping surface,

The invention claimed is:

1. A shell and tube heat exchanger, comprising:

a shell having a first inlet and a first outlet for a first medium and a second inlet and a second outlet for a second medium;

a tube bundle received in the shell for passage of the first medium, with the second medium flowing through a flow space within the shell in surrounding relation to the tube bundle, said tube bundle including a first group of tubes in communication with the first inlet for passage of the first medium, and a second group of tubes in communication with the first outlet and fluidly connected to the first group of tubes, said first group of tubes defining an outer enveloping surface which is predominantly adjacent to an enveloping surface of the second group of tubes;

a first tubesheet configured to receive ends of the tube bundle and separating the flow space for the second medium from the first medium; and a separating body embodied as a flow distributor and arranged between the first inlet and the first tubesheet to prevent the first medium from flowing against the first tubesheet, said separating body including inlet tubes which bridge a compensation space between the separating body and the first tubesheet and which protrude into the first group of tubes of the tube bundle, respectively, in order to direct the first medium into the first group of tubes while bypassing the first tubesheet.

2. The shell and tube heat exchanger of claim 1, wherein the inlet tubes of the separating body extend over at least half a thickness of the first tubesheet, with the thickness being measured between an upstream side and a downstream side of the first tubesheet in relation to a flow direction of the first medium.

3. The shell and tube heat exchanger of claim 1, designed as a double-tube safety heat exchanger, and further comprising:

a second tubesheet arranged on a downstream side of the first tubesheet; and a plurality of outer tubes received in the second tubesheet, wherein the tubes of the first group of tubes for passage of the first medium are each arranged in a corresponding one of the outer tubes so that a monitorable leakage space is arranged between the first group of tubes and the outer tubes.

4. The shell and tube heat exchanger of claim 1, further comprising:

an outlet side tubesheet; and a further separating body embodying a flow collector and arranged in a flow direction of the first medium behind the outlet-side tubesheet, said separating body including discharge tubes which are connected in a fluid-conducing manner to the tubes of the first group of tubes to conduct the first medium through the outlet-side tubesheet and the separating body to the first outlet.

5. The shell and tube heat exchanger of claim 1, further comprising a collecting chamber arranged between the separating body and the first tubesheet and connected to the first output, said second group of tubes feeding into the collecting chamber.

6. The shell and tube heat exchanger of claim 1, wherein the inlet tubes of the operating body are arranged for longitudinal displacement in the tubes of the first group of tubes, wherein any leakage flow is collectable in the compensation space between the separating body and the first tubesheet.

7. The shell and tube heat exchanger of claim 5, wherein the compensation space is connected to the collecting chamber in a fluid-conducting manner.

8. The shell and tube heat exchanger of claim 1, wherein the inlet tubes of the separating body completely traverse the separating body and are connected to the separating body on an inlet side.

9. The shell and tube heat exchanger of claim 1, wherein the first inlet feeds into an inflow chamber.

* * * * *